United States Patent [19]

Chodash

[11] 3,942,473

[45] Mar. 9, 1976

[54] APPARATUS FOR ACCRETING COPPER

[75] Inventor: Charles M. Chodash, Massapequa, N.Y.

[73] Assignee: Columbia Cable & Electric Corporation, Brooklyn, N.Y.

[22] Filed: Jan. 21, 1975

[21] Appl. No.: 542,662

[52] U.S. Cl. ..... 118/610; 118/405; 164/86; 164/266; 266/9; 266/11

[51] Int. Cl.[2] ..... B05C 3/12

[58] Field of Search ..... 75/72, 74, 76; 164/55, 164/86, 266; 118/404, 405, 600, 603, 610; 266/9, 11; 427/432

[56] References Cited

UNITED STATES PATENTS

| | | | |
|---|---|---|---|
| 284,005 | 8/1883 | Hainsworth | 164/266 |
| 397,365 | 2/1889 | Ianke | 266/35 |
| 1,037,538 | 9/1912 | Rockey et al. | 75/76 |
| 1,058,941 | 4/1913 | Blair | 75/76 |
| 1,198,434 | 9/1916 | Garred | 75/76 |
| 2,429,584 | 10/1947 | Poland | 75/76 X |
| 3,060,053 | 10/1962 | Carreker, Jr. et al. | 164/86 X |
| 3,199,977 | 8/1965 | Phillips et al. | 75/72 X |

*Primary Examiner*—Roy Lake
*Assistant Examiner*—Paul A. Bell
*Attorney, Agent, or Firm*—Arthur B. Colvin

[57] ABSTRACT

The present invention is directed to an improved apparatus for the formation by accretion of copper stock of substantially homogeneous composition intended to be subsequently formed by drawing, rolling, etc. into wire rods, sheets, tubes, strip or the like. The invention, in general, is directed to the combination with an essentially known fuel fired melting furnace and a known accreting crucible apparatus, of a launder or conduit for receiving copper from the furnace, which copper may contain an unacceptably high percentage of oxygen, and depositing said copper in the crucible with the oxygen content reduced to a degree rendering the same satisfactory for accretion onto a purified copper seed rod.

6 Claims, 10 Drawing Figures

APPARATUS FOR ACCRETING COPPER

BACKGROUND OF THE INVENTION

1. Field of the Invention

The present invention is in the field of manufacture of copper intermediate stock intended to be subsequently processed by known methods for formation into wire, sheet, tubes, strip, buss bars and the like.

2. The Prior Art

A significant proportion of the cost of manufacturing finished products of copper, such as wire, sheet, rod, etc., is attributable to the fabrication of the intermediate forms of the material from which the final products are to be manufactured.

A procedure which has successfully been adopted to reduce the cost of producing intermediate stock is the so-called accretion method wherein a continuous length of seed rod or wire of purified copper is progressively advanced under controlled conditions through a crucible containing molten copper, with the result that increments of the molten copper accrete on the advancing rod or wire. The resultant substantially thicker rod or wire is comprised of a solid body of substantially homogeneous copper suitable for subsequent processing.

Various procedures for refining of copper by accretion are disclosed in the patent art, such as, by way of example, in U.S. Pat. Nos. 3,008,201, 3,060,053 and 3,235,960.

A requirement of the accretion process as illustrated in said patents is that the molten copper in the crucible through which the seed rod is drawn be exceedingly pure, and especially be free of oxygen contaminants, either in the free state or combined with the copper as oxides. Specifically, it is stated in U.S. Pat. No. 3,060,503 that the oxygen content of the melt in the accreting crucible not exceed about 20 parts per million (ppm).

Heretofore the production of a melt of a requisite purity and freedom from oxygen contamination has required the use of an electrical melting furnace. All other means for melting the copper, and specifically fuel fired furnaces, in which combustion takes place in contact with the copper being melted, have resulted in the incorporation in the melt of an unacceptably high oxygen content.

Increasing charges for electrical energy, particularly in certain areas of the United States, have so greatly increased the costs of electrical melting furnace procedures as to make their use prohibitively expensive.

Attempts have been made to utilize fuel fired melting furnaces to provide molten copper to the accreting crucible. However, even the most efficient of such fuel fired furnaces, in the sense that the same produces copper with a low oxygen content, namely a furnace such as described in U.S. Pat. No. 3,199,977, results in a copper melt containing approximately 100 ppm oxygen.

SUMMARY

The present invention may be summarized as directed to an apparatus for the production by accretion of a solid body of substantially homogeneous copper, which apparatus includes a fuel fired furnace and an accreting crucible apparatus of essentially conventional design in combination with a launder or conduit of novel design, adapted to receive molten, oxygen-contaminated copper from the furnace, and in the course of conveying the same to the receiving crucible, reduce the oxygen content from approximately 100 or more ppm as received from the furnace to 20 or less ppm as deposited in the crucible.

The launder comprises an elongated conduit lined with refractory material and sealed to the atmosphere. The launder includes an internal passage inclined to the horizontal, the passage being interrupted by a plurality of longitudinally spaced-apart, transversely extending baffle means or members.

The baffle means or members include throughgoing, restricted flow passages, the cross sectional extent of which is less than the average cross sectional dimension of the stream of copper traversing the launder. The baffles include upper edge portions terminating in spaced relation to the ceiling or upper wall of the passage, the throughgoing apertures in the baffles being located at a level between the floor of the launder and the upper edge of the baffles.

A bed of pulverulent charcoal or like material is floated on a stream of molten copper, the depth or thickness of the bed being such as to include components lying below and, preferably, also above the height of the top edge of the baffles. The bed of charcoal is prevented from traveling in a downstream direction with the copper and its initially distributed condition essentially preserved by the entering of the top edge portions of the baffles into the bed. Additionally, the restricted apertures of the baffles form the surface of the stream of copper into an undulant pattern, increasing the surface area and, hence, the area exposed to the charcoal, the turbulence or disruption of laminar flow resulting from the stream passing through the apertures likewise assuring that all portions of the molten stream will, at one time or another, be contacted with the charcoal.

Means are preferably provided for varying the inclination of the launder, to vary the flow rate of molten copper, permitting the launder to be accommodated to varying quantities of oxygen contaminant in a particular batch of copper melt.

The launder is heated to maintain the copper in the molten condition and may likewise include means for interposing in the area above the charcoal bed an atmosphere of reducing gas.

Accordingly, it is an object of the invention to provide an improved apparatus for the formation of copper intermediates by an accretion process.

It is a further object of the invention to provide an apparatus of the type described, permitting the use of a fuel fired furnace as the means for reducing the copper to molten form.

A further object of the invention is the provision in an accreting apparatus of the type described of a launder or conduit of relatively limited size within which oxygen contaminated copper melt may be treated to reduce the oxygen content to a level acceptably low, i.e. in the area of 20 ppm oxygen, for use in an accreting procedure.

Still a further object of the invention is the provision of an accreting apparatus eliminating the requirement for an electrical melting furnace and permitting the use of more efficient fuel fired melting furnaces of the type in which there is direct contact between the copper and combustion products.

To attain these objects and such further objects as may appear herein or be hereinafter pointed out, reference is made to the accompanying drawings, forming a part hereof, in which.

Figure 1:
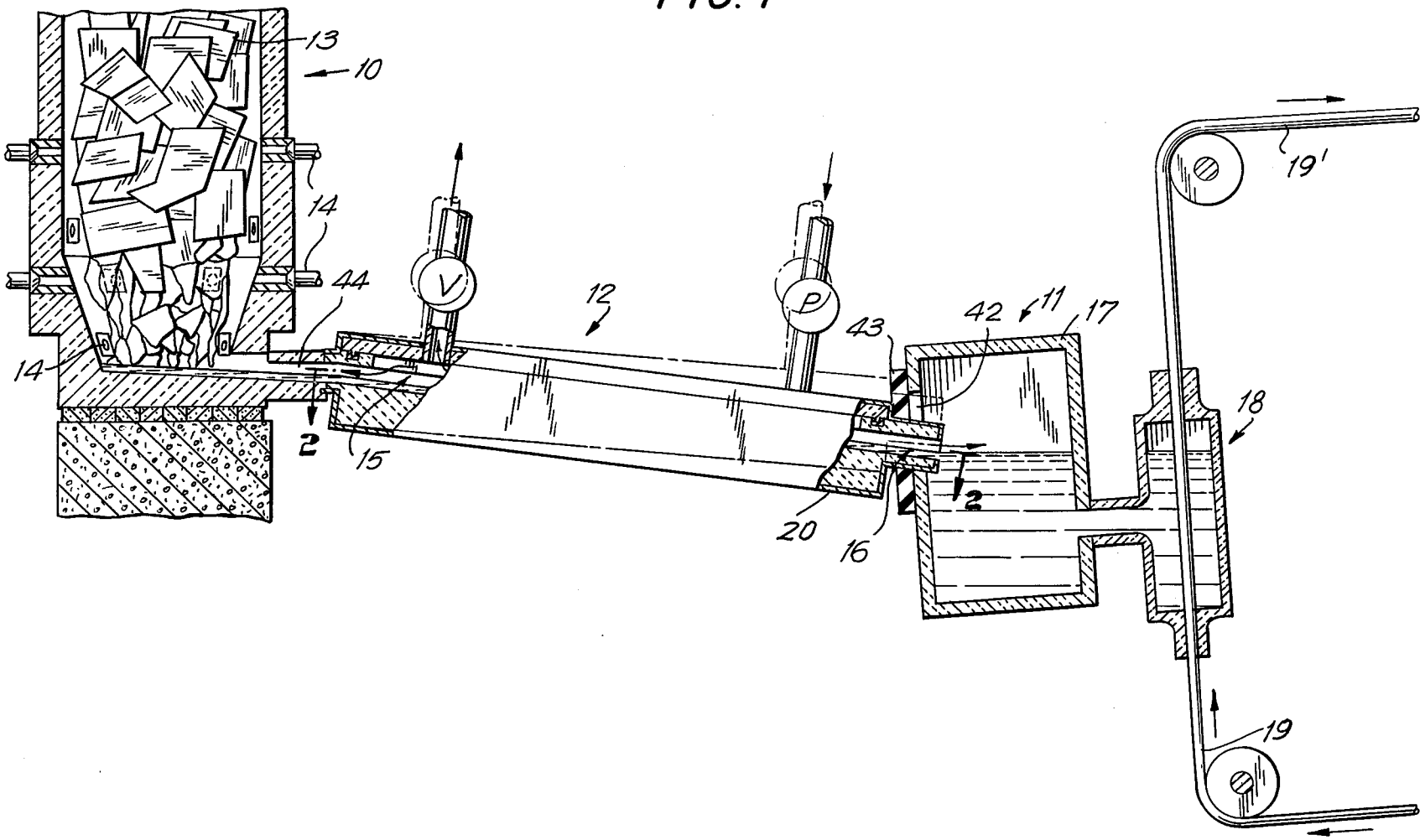
FIG. 1 is a schematic illustration in vertical section of an accretion apparatus in accordance with the invention.

Referring now to the drawings, there is shown in FIG. 1, in schematic fashion, an accretion apparatus including a fuel fired furnace 10 for melting copper material, an accreting crucible 11 and a deoxygenating launder or conduit assembly 12 for conducting the molten copper to the accreting chamber and for deoxygenating the same in the course of traversing the launder.

The furnace 10 may be of the type shown in U.S. Pat. No. 3,199,977 or any other similar type preferably producing a copper melt having a relatively low oxygen content, in the neighborhood for instance of 100 ppm. It will be appreciated from the ensuing discussion that furnaces producing copper melt having higher oxygen concentrations may be employed but that the length of the conduit or launder assembly 12 may be required to be increased to provide additional treatment area for the more oxygen rich copper.

Copper aggregate 13 is progressively loaded into the furnace, the aggregate being heated in direct contact with combustion products resulting from the burning of combustion gases introduced through the burner ports 14. The copper aggregate comprises a stack supported by unmelted portions, the furnace being so constructed and arranged that a continuous drawing off of molten material at the bottom of the stack occurs.

As more fully set forth in U.S. Pat. No. 3,199,977, the combustion mixture is preferably regulated in such manner that the oxygen content is insufficient to produce full combustion of the fuel elements, and combustion takes place in the presence of reducing gases.

As noted, other furnaces or sources of molten copper may be substituted for the furnace 10 which, per se, forms no part of the instant invention.

Molten copper tapped from the furnace 10 and passing through internal passageway 15 of the launder emerges from exit end 16 into supply or reservoir crucible 17 feeding accreting crucible 18. As noted in respect of the three patents first mentioned above, a substantially homogeneous solid copper rod is produced in crucible 18 by progressively drawing through the crucible a relatively thin wire or rod 19 of essentially pure copper. In the course of traversing the crucible 18, the wire or rod 19 gathers on its surface quantities of copper which become integrated with the mass, resulting in the production of a wire or rod 19' of greater diameter than the rod 19.

The various parameters required for the production of rod stock by accretion, including the speed with which the rod is drawn, temperatures, seals to the atmosphere and the like, are so fully and completely expounded in the aforesaid U.S. Pat. Nos. 3,008,201, 3,060,053 and 3,235,960, for instance, as to render repetition unnecessary.

Important to the instant invention, however, is the fact that unless the copper melt within the accreting crucible 18 is in the range of about 20 or less ppm of oxygen, the accreted material may not be properly bonded to the core material. Also, the accreted rod may evidence surface fissures and cracks, and may be irregular in shape.

Accordingly, the principal contribution of the instant invention lies in the provision of a processing launder 12 of relatively limited length wherein oxygen contaminated copper melt is delivered to the crucible in a condition sufficiently decontaminated to permit practice of an accretion process producing a satisfactory rod or wire.

The launder 12 includes an encapsulating steel casing 20 which is lined with insulation 21. A refractory layer 22 is disposed within the softer insulating material. The refractory material 22 defines a trough 23 (see FIG. 4) having a V shaped floor 24 provided with carbide liners or like material possessing the necessary heat resisting and wear resisting properties. The side walls 25, 26 of the trough are likewise formed of carbide material.

The above described components comprise the bottom half segment of the launder 12, the upper half segment 27 of the lining for the launder being made of a refractory material.

The upper and lower halves of the launder form a sealed enclosure, to which end the segment 27 may include depending side ribs 28, 29 which project downwardly into complemental channels 30, 31, respectively, in the refractory portion 21 of the lower launder section. Preferably a heat resistant, yieldable packing component 32, 33 is disposed in the channels 30, 31 to assure formation of an airtight seal.

The steel casing 20 is preferably formed in two halves, notably an upper and a lower half, encapsulating, respectively, the upper half 27 of the launder, the lower half containing the lower section of the launder, whereby, by separating the casing halves, the launder may be opened to provide access to the interior.

Figure 2:
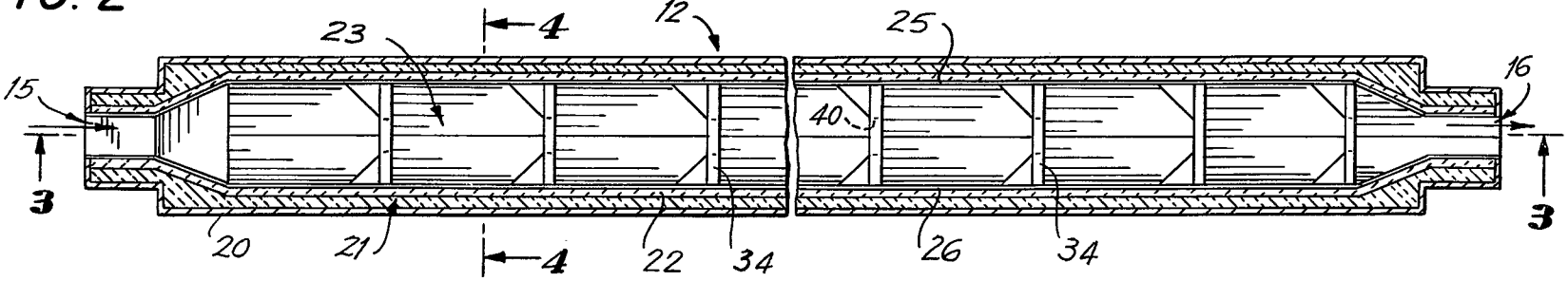
FIG. 2 is a horizontal section taken on the line 2—2 of FIG. 1.
Figure 3:
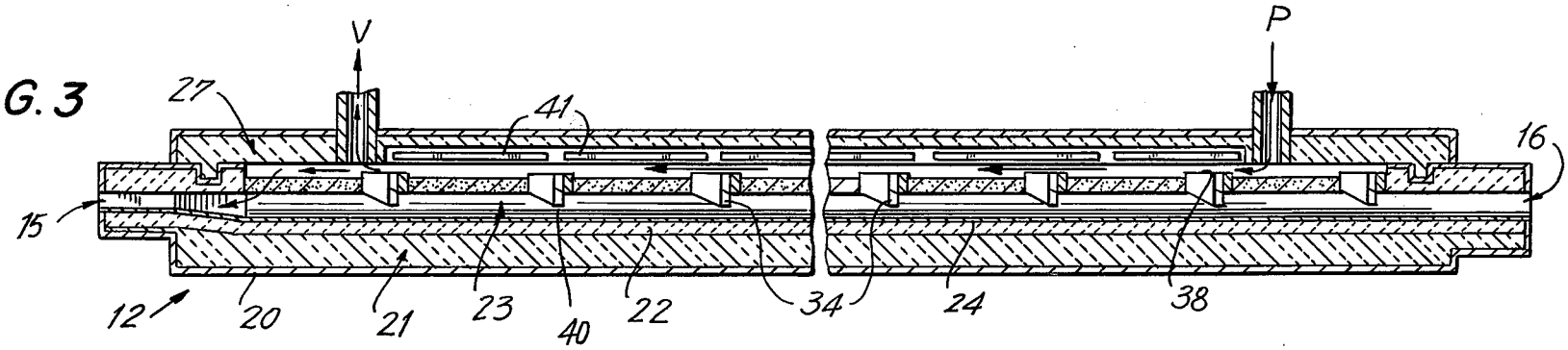
FIG. 3 is a vertical section taken on the line 3—3 of FIG. 2.

A plurality of baffle members 34 are interposed within the trough portion 23 of the launder. The baffles 34, in the embodiment of FIGS. 2 and 3, are formed of carbide material and include side walls 35, 36 engaging the side walls of the trough 25, 26, respectively, and an angular bottom wall portion 37 conforming to the floor 24 of the trough. The upper edge portions 38 of the baffles extend toward and terminate in spaced relation to the top wall portion 39 of the upper section 27 of the launder.

The baffles 34 include throughgoing apertures 40. The apertures 40 are preferably defined adjacent the floor 24 of the launder. It will be observed that the cross sectional area of the apertures 40 forms only a small proportion of the total area of the baffles 34. The sectional area of the apertures is calculated to comprise a minor fraction of the average cross sectional area of the copper stream to be processed.

Each half of the baffles 34 to opposite sides of a vertical plane bisecting the launder is angularly oriented in a downstream direction, the baffles being generally chevron shaped in horizontal section. Such construction increases the desired turbulence effect on the copper stream, as well as functioning to create at the upstream surface of the baffles immediately above the throughgoing apertures 40 a greater stream height, whereby the interaction between the charcoal bed and reducing gases introduced into the system and the oxygen content of the stream is increased.

Figure 4:
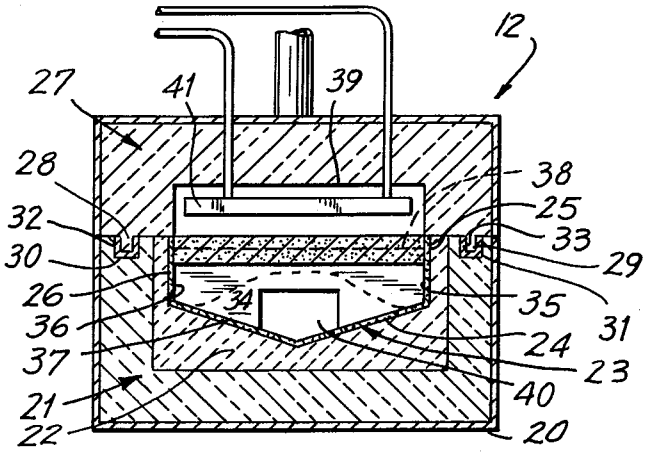
FIG. 4 is a magnified vertical section taken on the line 4—4 of FIG. 2.

Heating means are provided for maintaining the copper flowing the length of the launder in molten condition. In the embodiment of FIGS. 2 to 4, the heating means comprises radiant heaters 41 which may be electrically powered.

In advance of operation of the device, a blanket or bed of pulverulent deoxidizing material, such as charcoal, is deposited within the launder. The blanket is preferably positioned by separating the two halves of the launder at the seal area and partially filling the trough portion 23 with the material.

The exit end 16 of the launder is disposed within an aperture 42 formed in the supply crucible 17, whereby molten copper flowing through the launder will be deposited in the crucible. An airtight trap member 43 surrounding the exit end 16 and disposed outwardly adjacent the aperture 42 or a comparable and articulatable seal, prevents the ingress of air to the system while permitting a degree of movement of the exit end 16 of the launder relative to the crucible 17.

There is maintained within the launder a reducing atmosphere. Optionally and preferably the launder includes an inlet port P adjacent the exit end of the launder, through which a reducing gas such as carbon monoxide, hydrogen or the like may be introduced.

A vent control mechanism V is formed in the launder adjacent the end nearest the furnace 10. Control means are provided within the vent apparatus whereby gases at the vent may selectively be removed and suitably disposed of or, if the venting mechanism is closed to a degree, increments of the gases may be fed into the furnace 10 at the lower end of the column of copper to mingle and burn with the combustion gases.

Operation of the apparatus will be apparent from the preceding description.

Molten copper emerging from the furnace 10 and incorporating oxygen in quantities of approximately 100 ppm or more is fed from the exit orifice 44 of the furnace 10 to the entrance of the passageway 15 of the launder. The volumetric flow of molten copper will be controlled in accordance with the oxygen content thereof by increasing or decreasing the fuel supply to the furnace, it being understood that where the molten copper possesses a relatively low oxygen content, a larger capacity of copper may be permitted to flow through the launder and, consequently, a greater amount of heat may be utilized to increase the volumetric yield.

Additionally, the volumetric flow may be varied by modifying the tilt of the launder (compare dot and dash and solid line positions shown in FIG. 1). The greater the inclination of the launder, the faster the flow of materials, with a consequent diminished exposure of the molten copper to the influences of the charcoal and reducing gases.

Under the illustrated arrangement, reducing gases introduced through port P flow additionally into the holding or reservoir crucible 17, where their principal function is not to augment the de-oxidization but, rather, to prevent contact of the molten material with oxidizing influences.

The baffles 34 perform an important function in the launder of the present invention—specifically, to increase the area of molten copper exposed to the reducing influences of the charcoal and gas. As the stream of molten copper flows down the launder and engages against each of the baffles, the baffles act as a flow restrictor, by reason of the limited size of the apertures formed therethrough, with the result that the level of the molten stream immediately upstream of each baffle is substantially higher than the further level both upstream and downstream of the baffles. In other words, the stream tends to collect at a greater height immediately before the baffles by reason of the restricted flow apertures.

Additionally, there is a turbulence effect occasioned by the presence of the baffles and apertures which results in a circulation within the molten stream, wherein portions of the stream which might otherwise, by reason of laminar flow effects, remain submerged and remote from the deoxygenating influences of the charcoal and gas, are caused to approach the surface.

A further important feature of the invention lies in the interaction between the baffles and the charcoal bed whereby the entire length of the launder is maintained functionally effective to deoxygenate the molten stream, notwithstanding the progressive depletion of the charcoal bed through combination with the oxygen products within the molten stream. If the bed were permitted to shift freely within the launder, there would be a tendency, as charcoal is depleted, for the remaining quantities to accumulate adjacent the downstream end of the launder, whereby upstream portions of the molten metal would not be covered by charcoal.

In the instant device, the baffles enter into the bed of charcoal whereby the bed is maintained substantially in a fixed position and cannot bodily be shifted, due to the restraining influences of the baffles.

Further, as the charcoal is depleted so that the upper edges of the baffles project above the uppermost surface of the charcoal bed, it is assured that increments of the charcoal will remain in each section divided by the baffles. Moreover, the increments of the bed will tend to collect immediately upstream of each baffle in the area of major turbulence.

As a result of the noted construction, a single charge of charcoal will last substantially longer, without sacrificing efficient deoxygenation, than would be the case if the charge were unconstrained within the launder.

It is important to note that the minor inclination of the launder in the area of from about 5° to about 20° enables the formation within the launder of a discrete stream of molten copper of readily controllable size, whereby it is feasible, with a controlled amount of heat, to maintain the stream at a desired temperature. In contrast, if the launder were vertical or substantially vertically oriented, it would be impossible to maintain the desired flow characters to assure a proper surface area and speed of flow to permit deoxygenation appropriate to the contamination of the particular batch being processed. Additionally, the heat required to maintain the molten condition in a vertically or near vertically descending molten stream is considerably greater, especially considering the additional length of launder which would, under such circumstances, be mandated.

The described construction makes it feasible to employ a launder of relatively short dimension while still effecting sufficient deoxygenation to enable the use of a gas or other fuel fired melting furnace and derive a molten copper product sufficiently free of oxygen to permit practice of an accretion procedure.

Figure 5:
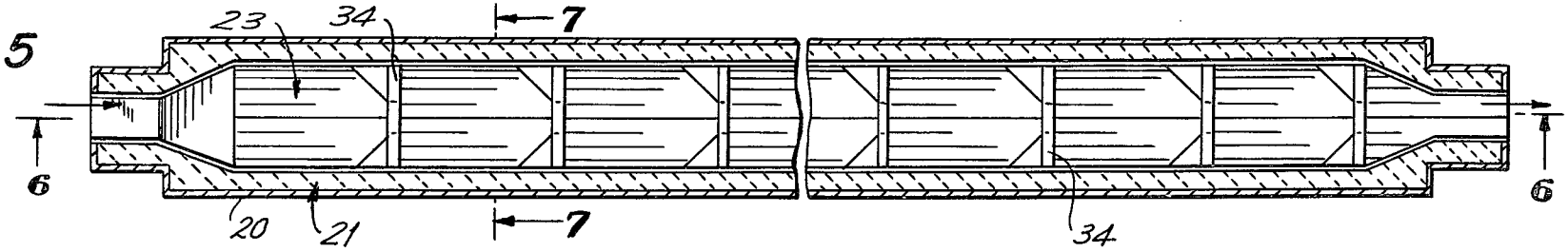
FIGS. 5, 6 and 7 are sectional views similar to FIGS. 2, 3 and 4 of a further embodiment of the invention.
Figure 6:
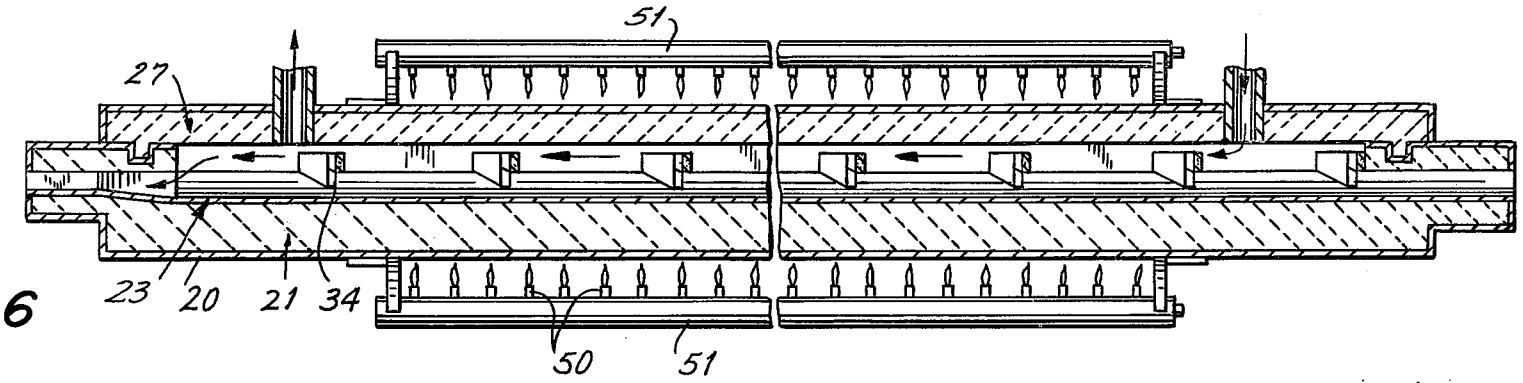
Figure 7:
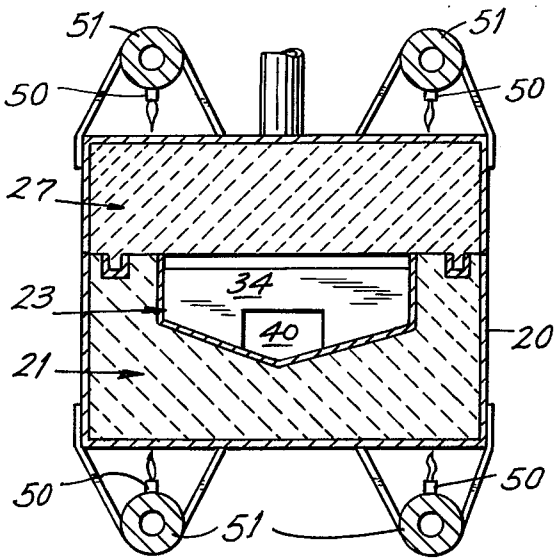

In FIGS. 5 to 7 there is shown a variation of the launder wherein the heating effects for maintaining the stream in molten condition are provided by a multiplicity of externally mounted gas jets 50, fed from common manifolds 51. With the exception of the heating means, the launder of FIGS. 5 to 7 is essentially identical to the launder of FIGS. 2 to 4.

Figure 8:
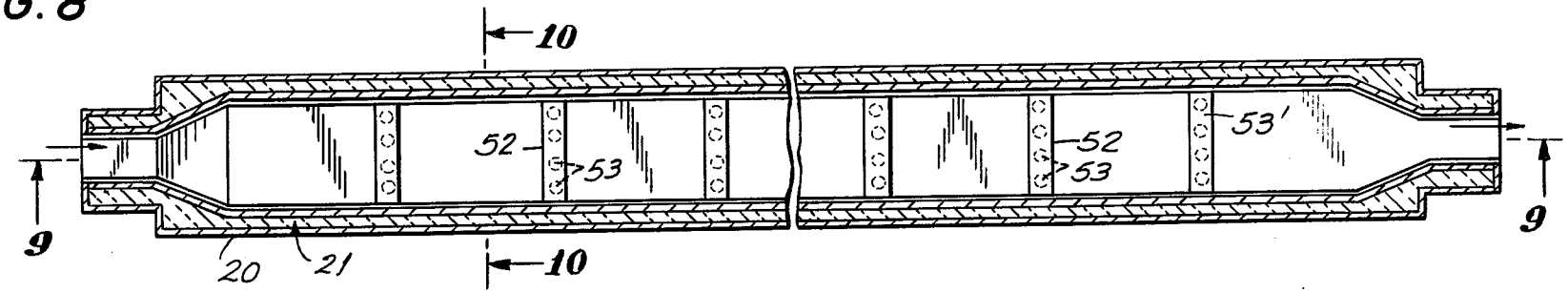
FIGS. 8, 9 and 10 are sectional views similar to FIGS. 2, 3 and 4 of a still further embodiment of the invention.
Figure 9:
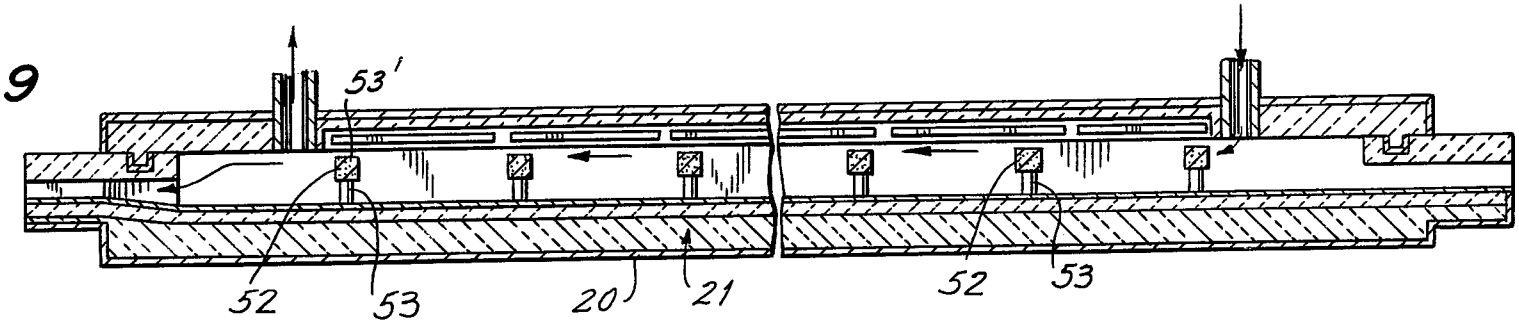
Figure 10:
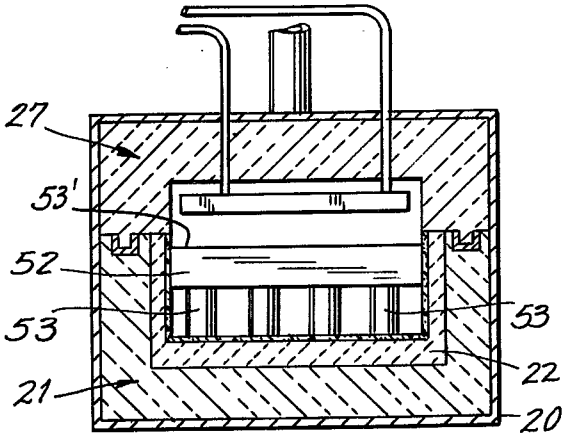

The launder of the embodiment of FIGS. 8 to 10 employs radiant heaters similar to those illustrated in FIGS. 2 to 4. In the embodiment of FIGS. 8 to 10, however, the baffle constructions differ from the previously described baffles.

As best seen in FIGS. 9 and 10, the baffles comprise transversely extending bridge portions 52, the upper edges 53' of which are spaced from the upper wall portions of the launder. The bridge portions 52 carry depending flow deflectors 53 in the path of the stream of metal.

It will be observed that the flow deflectors 53 function to interrupt laminar flow of the molten copper stream and induce a roiling effect therein, as well as to create elevated pools or puddles at the upstream surfaces of the baffles, in the manner previously described in connection with the baffles 34.

It will be appreciated that, depending upon the turbulence effects sought to be introduced into the stream, the flow deflecting portions 53 may be aligned longitudinally, as illustrated in FIG. 8, or they may be offset one from another on sequential baffles, whereby transverse increments of the stream are required to traverse sinous paths as they descend the launder, inducing a side to side flow characteristic.

As shown in the embodiment of FIGS. 8 to 10, the floor of the launder may be flat rather than trough-like.

It will be perceived by those skilled in the art that numerous and familiarized with the instant disclosure that numerous physical variations may be made in the illustrated apparatus without departing from the spirit of the invention. Specifically, variations in the configuration of the launder, baffles, etc. may be effected to meet specific requirements. By way of example, the entire launder may be fabricated in a sinuous configuration to induce a curved flow path whereby the length of the stream is increased without increasing the overall spacing between furnace and accretion crucible. Accordingly, the invention is to be broadly construed within the scope of the appended claims.

Having thus described my invention, what I claim as new and desire to secure by Letters Patent of the United States is:

1. In an apparatus for accreting copper including a fuel fired melting furnace means for melting copper stock and an accreting crucible within which a copper member is drawn through a pool of purified, molten copper, a deoxygenating launder apparatus inclined from said furnace toward said crucible for receiving molten, oxygen contaminated copper from said furnace and depositing said copper melt in purified condition in said crucible, comprising an enclosed, inclined conduit having an internal passage including bottom, top and side wall portions, a plurality of longitudinally spaced-apart baffle members extending transversely across said passage, the upper edge portions of said baffle members terminating in spaced relation to the top portion of said conduit, said baffle members including side portions conforming with side wall portions of said conduit, said baffle members including restricted flow passages, a stream of molten copper flowing from said furnace toward said crucible, the average cross sectional area of said stream taken transversely to the direction of flow being less than the cross sectional area of said baffles and greater than the area of said restricted passages, whereby the cross sectional area of said stream, upstream of said baffles, is substantially greater than the cross sectional area of said stream immediately downstream of said baffles, means for heating said conduit to maintain said copper in a molten condition and a charcoal bed floating on said stream, and including portions extending below the upper edge portions of said baffles, whereby said baffles prevent bodily movement of said bed in said downstream direction.

2. Apparatus in accordance with claim 1 and including means for varying the inclination of said conduit.

3. Apparatus in accordance with claim 1 and including means for introducing reducing gases into said conduit at a portion adjacent the crucible end thereof.

4. Apparatus in accordance with claim 1 wherein the restricted flow passages defined by sequential baffles are offset one from the other in a direction normal to the direction of flow, whereby said stream is caused to traverse a sinuous path.

5. Apparatus in accordance with claim 1 wherein said baffles to opposite sides of a vertical plane dividing said launder are inclined in the direction of flow of said launder, with portions of said baffles adjacent the side walls of said launder being located upstream as respects said cutout portions.

6. In an apparatus for accreting copper including a fuel fired melting furnace means for melting copper stock and an accreting crucible within which a copper member is drawn through a pool of purified, molten copper, a deoxygenating launder apparatus inclined from said furnace toward said crucible for receiving molten, oxygen contaminated copper from said furnace and depositing said copper melt in purified condition in said crucible, comprising an enclosed, inclined conduit having an internal passage, a plurality of longitudinally spaced-apart baffle members extending transversely across said passage, said baffles including adjacent the floor of said passage flow restricting apertures for the passage therethrough of molten copper, a bed of pulverulent reducing material disposed in said conduit and adapted to float on a stream of copper descending said passage at a level in which portions of said bed extend below said upper edge portions, whereby said baffles prevent downstream movement of said bed while permitting downstream movement of said molten copper through said apertures, the upper surface of said stream being above the level of said apertures and below the upper edge portions of said baffles, and means for heating said conduit to maintain a stream of copper in said passage in a molten condition.

* * * * *